US008870309B2

(12) United States Patent
Chen

(10) Patent No.: US 8,870,309 B2
(45) Date of Patent: Oct. 28, 2014

(54) COMBINATION CABINET WITH FOLDABLE DOOR

(71) Applicant: Shun-Teng Chen, Zhongli (TW)

(72) Inventor: Shun-Teng Chen, Zhongli (TW)

( * ) Notice: Subject to any disclaimer, the term of this patent is extended or adjusted under 35 U.S.C. 154(b) by 77 days.

(21) Appl. No.: 13/717,907

(22) Filed: Dec. 18, 2012

(65) Prior Publication Data

US 2014/0167583 A1 Jun. 19, 2014

(51) Int. Cl.
*A47B 96/00* (2006.01)
*E05D 15/26* (2006.01)
*E06B 3/50* (2006.01)

(52) U.S. Cl.
CPC ..... *E06B 3/5045* (2013.01)
USPC ..... 312/324; 160/206; 160/229.1

(58) Field of Classification Search
CPC ... E06B 3/485; E06B 3/5045; E06B 65/0085; A47B 96/00; E05D 15/264; E05Y 2900/20; E05Y 2900/21
USPC ..... 312/109, 297, 324, 326, 329; 49/125; 160/118, 135, 199, 206, 229.1, 234
See application file for complete search history.

(56) References Cited

U.S. PATENT DOCUMENTS

| | | | | |
|---|---|---|---|---|
| 5,782,282 | A * | 7/1998 | Chen | 160/206 |
| 5,813,739 | A * | 9/1998 | White | 312/409 |
| 6,267,525 | B1 * | 7/2001 | Wu | 403/49 |
| 6,574,837 | B2 * | 6/2003 | Jantschek | 16/371 |
| 7,322,661 | B1 * | 1/2008 | Salvesen | 312/322 |
| 7,946,665 | B2 * | 5/2011 | Backhaus et al. | 312/325 |
| 8,312,596 | B2 * | 11/2012 | Self | 16/354 |

* cited by examiner

*Primary Examiner* — James O Hansen
(74) *Attorney, Agent, or Firm* — Alan Kamrath; Kamrath IP Lawfirm, P.A.

(57) ABSTRACT

A combination cabinet includes at least one pair of door frames, at least one separation bar mounted between the door frames, a pair of fixing seats mounted on the separation bar, and a plurality of pivot pieces each mounted in a respective one of the door frames and each pivotally connected with a respective one of the fixing seats. The separation bar has an upper end and a lower end each provided with a slot for mounting a respective one of the fixing seats. Each of the fixing seats has a side provided with an insert inserted into the respective slot of the separation bar. Thus, the separation bar closes the gap between the door frames during pivotal movement of the door frames, thereby preventing a person from being clamped or hurt by the gap between the door frames.

13 Claims, 23 Drawing Sheets

COMBINATION CABINET WITH FOLDABLE DOOR

BACKGROUND OF THE INVENTION

1. Field of the Invention

The present invention relates to a house furniture, such as a cabinet, case, wardrobe, closet, cupboard and the like, and, more particularly, to a combination cabinet with a foldable door.

2. Description of the Related Art

A conventional cabinet comprises a cabinet body and a door frame connected with the cabinet body. The door frame includes a track mounted on the cabinet body and two pull doors movably mounted on the track. However, when the pull doors are opened, the pull doors occupy one half of the opening space, thereby limiting the opening space. Alternatively, the door frame includes a single door pivotally mounted on a side of the cabinet body. Thus, when the door is pivoted outward, the cabinet body is opened, and when the door is pivoted inward, the cabinet body is closed. However, when the door is pivoted outward to open the cabinet body, the door protrudes outward from the cabinet body, so that the door will occupy a large space. Alternatively, the door frame includes two juxtaposed doors pivotally mounted on two opposite sides of the cabinet body. Thus, when the doors are pivoted outward, the cabinet body is opened, and when the doors are pivoted inward, the cabinet body is closed. However, when the doors are pivoted outward to open the cabinet body, the doors also protrude outward from the cabinet body, so that the doors will occupy a large space. In addition, a gap is defined between the cabinet body and each of the doors so that a user is easily clamped by the gap between the cabinet body and each of the doors during pivotal movement of each of the doors, thereby causing danger to the user.

BRIEF SUMMARY OF THE INVENTION

In accordance with the present invention, there is provided a combination cabinet, comprising at least one pair of door frames, at least one separation bar mounted between the door frames, a pair of fixing seats mounted on the separation bar, and a plurality of pivot pieces each mounted in a respective one of the door frames and each pivotally connected with a respective one of the fixing seats. The separation bar has an upper end and a lower end each provided with a slot for mounting a respective one of the fixing seats. Each of the fixing seats has a side provided with an insert inserted into the respective slot of the separation bar.

According to the primary advantage of the present invention, the separation bar fully seals the gap between the door frames when the door frames are fully expanded, fully folded or inclined relative to each other, thereby enhancing the aesthetic quality of the door frames.

According to another advantage of the present invention, the separation bar closes the gap between the door frames during pivotal movement of the door frames, thereby preventing a person from being clamped or hurt by the gap between the door frames.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
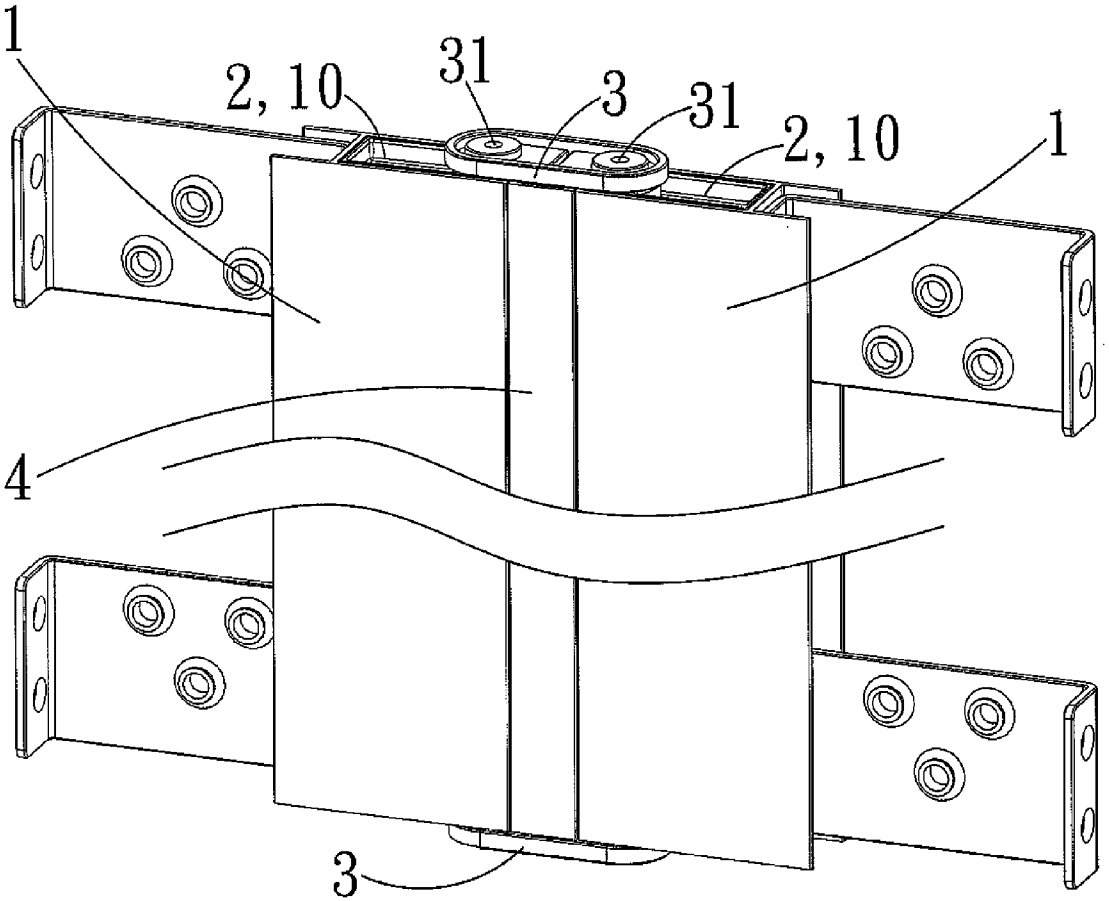
FIG. 1 is a partially perspective view of a combination cabinet in accordance with the preferred embodiment of the present invention.
Figure 2:
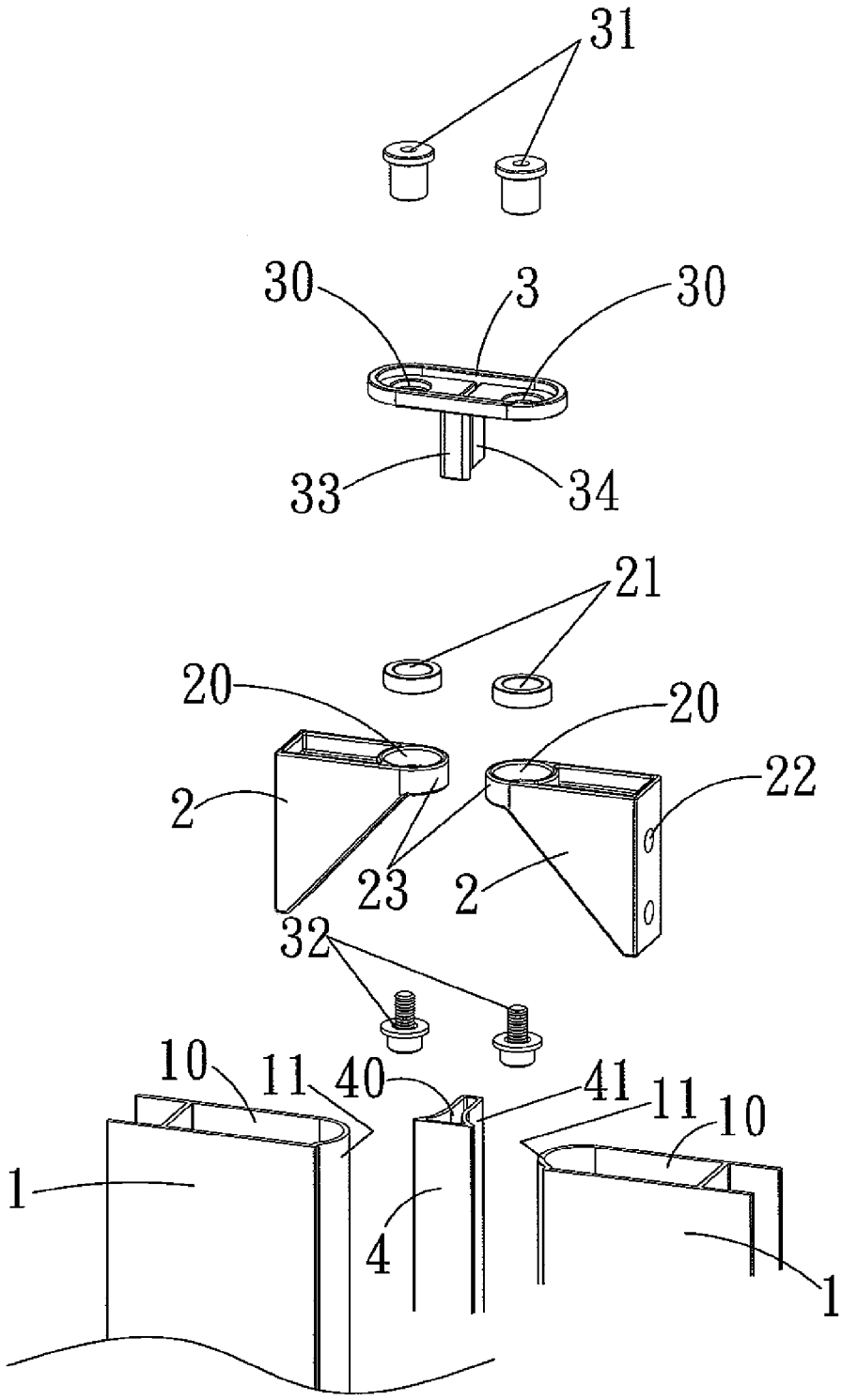
FIG. 2 is a partially exploded perspective view of the combination cabinet as shown in FIG. 1.

Referring to the drawings and initially to FIGS. 1-5, a combination cabinet in accordance with the preferred embodiment of the present invention comprises at least one pair of door frames 1, at least one separation bar 4 mounted between the door frames 1, a pair of fixing seats 3 mounted on the separation bar 4, a plurality of pivot pieces 2 each mounted in a respective one of the door frames 1 and each pivotally connected with a respective one of the fixing seats 3, and a plurality of bearings 21 each mounted in a respective one of the pivot pieces 2.

Each of the door frames 1 has an upper end and a lower end each provided with a fixing hole 10 for mounting a respective one of the pivot pieces 2. Each of the door frames 1 has a side provided with a first arcuate portion 11.

Each of the pivot pieces 2 has a first end provided with a shaft hole 20 for mounting a respective one of the bearings 21, and a second end provided with a fixing portion 22 secured in the fixing hole 10 of the respective door frame 1. Each of the pivot pieces 2 has a side provided with a second arcuate portion 23 abutting the first arcuate portion 11 of the respective door frame 1.

The separation bar 4 has an upper end and a lower end each provided with a slot 40 for mounting a respective one of the fixing seats 3. The separation bar 4 has two opposite sides each provided with a third arcuate portion 41 abutting the first arcuate portion 11 of the respective door frame 1.

Each of the fixing seats 3 has two opposite ends each provided with a shaft bore 30. The shaft bore 30 of each of the fixing seats 3 aligns with the shaft hole 20 of a respective one of the pivot pieces 2. Each of the fixing seats 3 has a side provided with an insert 33 inserted into the respective slot 40 of the separation bar 4. The insert 33 of each of the fixing seats 3 has two opposite sides each provided with a fourth arcuate portion 34 abutting the respective third arcuate portion 41 of the separation bar 4.

The combination cabinet further comprises two pairs of shafts 31 each extended through the shaft bore 30 of a respective one of the fixing seats 3 and the shaft hole 20 of a respective one of the pivot pieces 2 to pivotally connect the fixing seats 3 with the pivot pieces 2, and two pairs of fastening members 32 each locked onto a respective one of the shafts 31 to fix the respective shaft 31.

Figure 3:
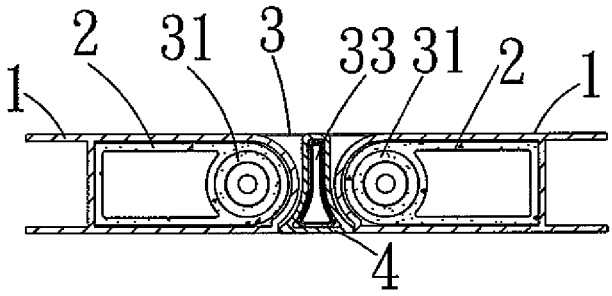
FIG. 3 is a partially top cross-sectional view of the combination cabinet as shown in FIG. 1.
Figure 4:
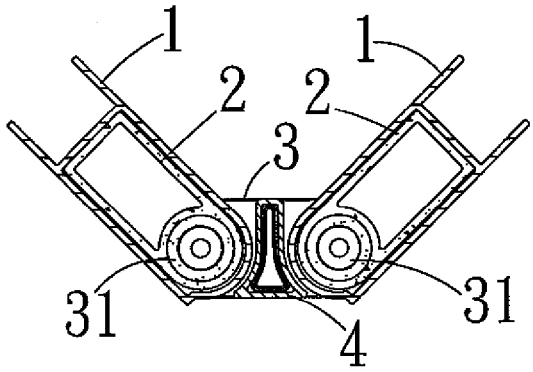
FIG. 4 is a schematic operational view of the combination cabinet as shown in FIG. 3.
Figure 5:
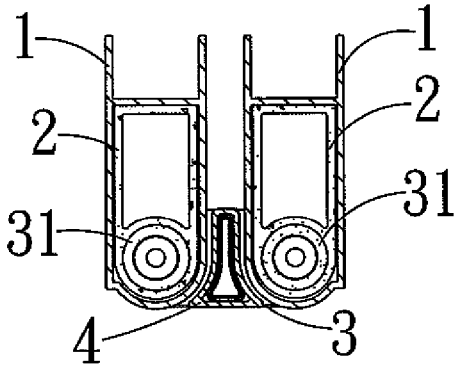
FIG. 5 is a schematic operational view of the combination cabinet as shown in FIG. 4.
Figure 6:
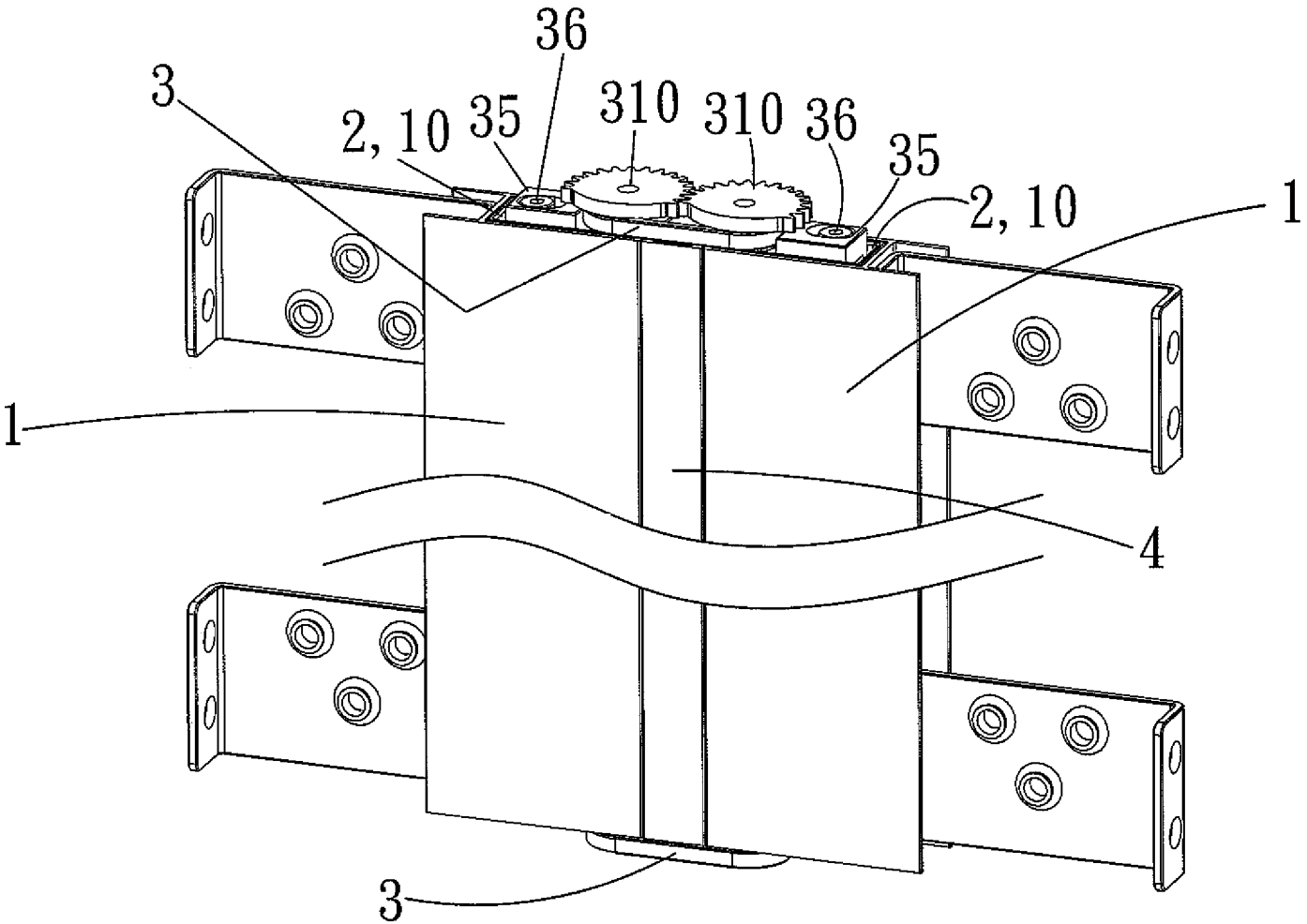
FIG. 6 is a partially perspective view of a combination cabinet in accordance with another preferred embodiment of the present invention.
Figure 7:
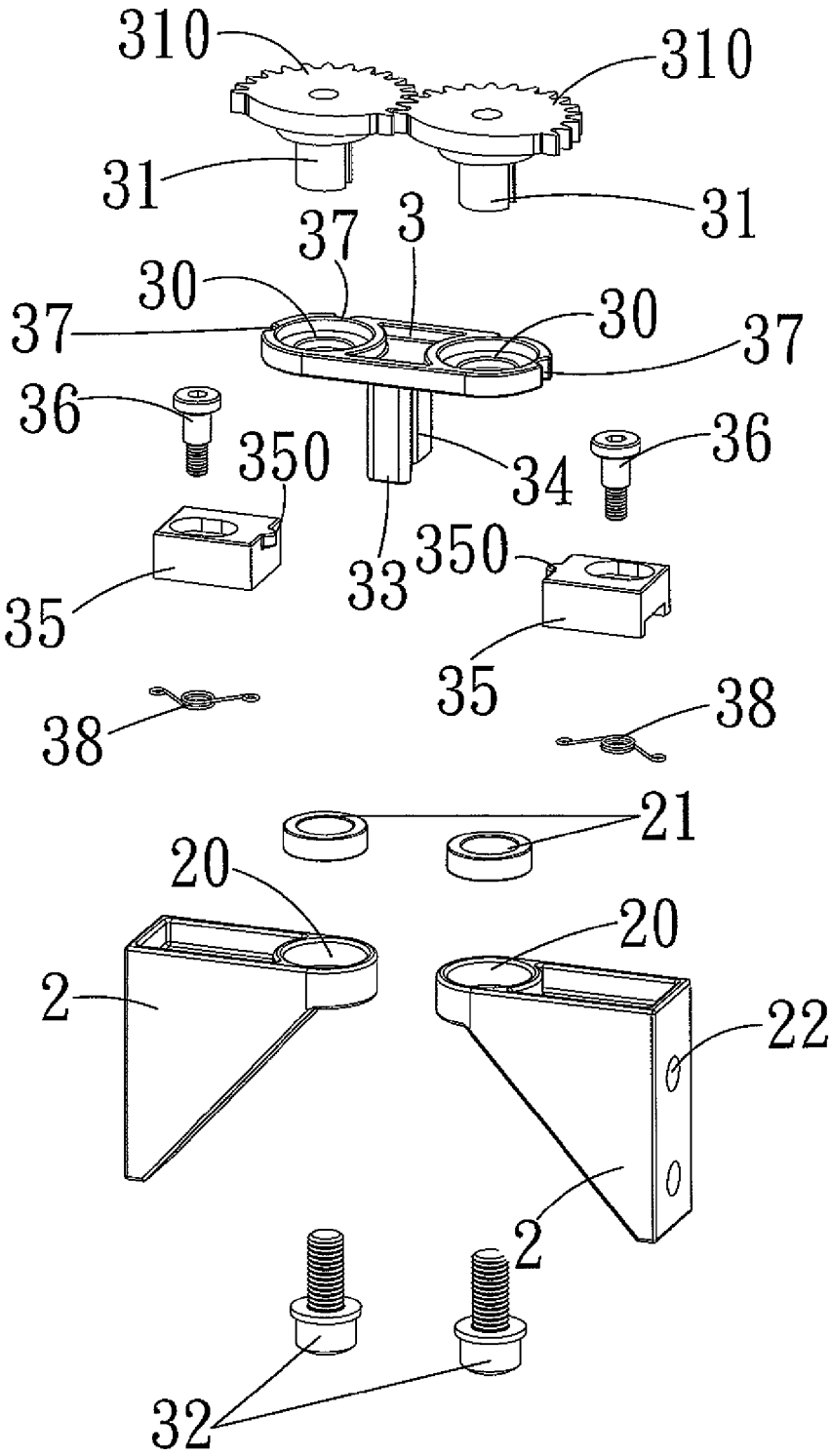
FIG. 7 is a partially top exploded perspective view of the combination cabinet as shown in FIG. 6.
Figure 8:
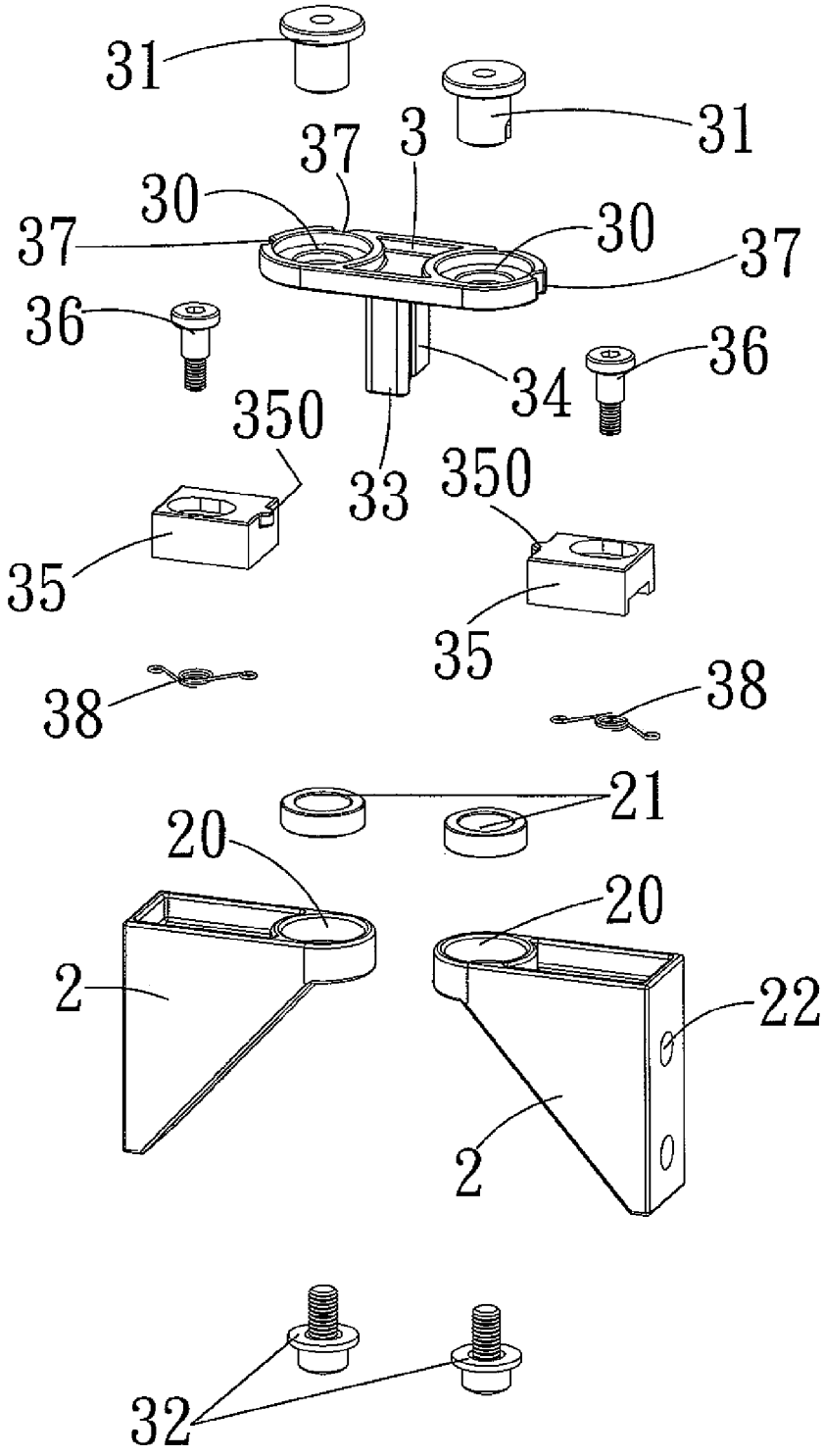
FIG. 8 is a partially bottom exploded perspective view of the combination cabinet as shown in FIG. 6.
Figure 9:
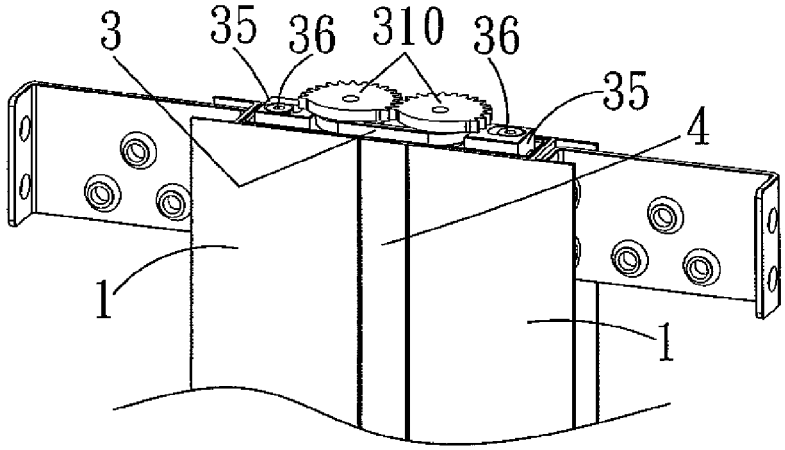
FIG. 9 is a schematic operational view of the combination cabinet as shown in FIG. 6.
Figure 10:
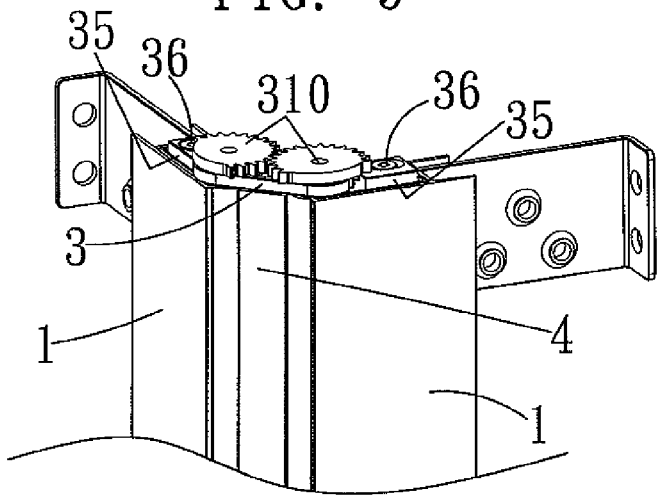
FIG. 10 is a schematic operational view of the combination cabinet as shown in FIG. 9.
Figure 11:
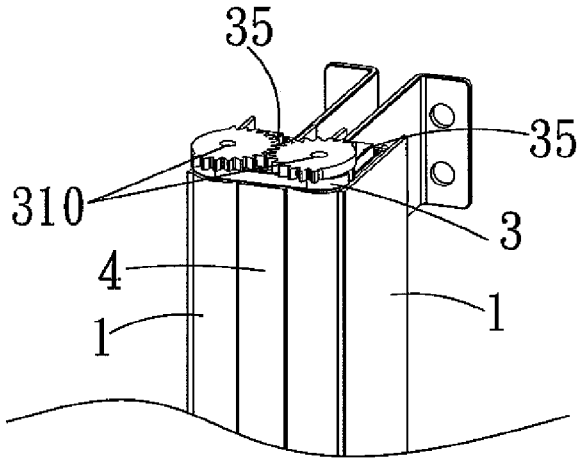
FIG. 11 is a schematic operational view of the combination cabinet as shown in FIG. 10.

In operation, the door frames 1 are pivoted relative to each other. As shown in FIG. 3, the door frames 1 are fully expanded. As shown in FIG. 4, the door frames 1 are half folded. As shown in FIG. 5, the door frames 1 are fully folded. Thus, the separation bar 4 seals the gap between the door frames 1 when the door frames 1 are fully expanded, fully folded or inclined relative to each other, to enhance the aesthetic quality of the door frames 1 and to prevent a person from being clamped or hurt by the gap between the door frames 1.

Referring to FIGS. 6-14, the combination cabinet further comprises one pair of gears 310 each secured on a respective one of the shafts 31 and each aligning with an upper one of the fixing seats 3, two pairs of positioning pieces 35 each secured on a respective one of the pivot pieces 2, two pairs of springs 38 each mounted on a respective one of the positioning pieces 35 and each biased between a respective one of the pivot pieces 2 and a respective one of the fixing seats 3 to provide a restoring function to the door frames 1, and two pairs of screws 36 each extended through a respective one of the positioning pieces 35 and a respective one of the springs 38 and each secured on a respective one of the pivot pieces 2 to lock the respective positioning piece 35 and the respective spring 38 onto the respective pivot piece 2.

Figure 12:
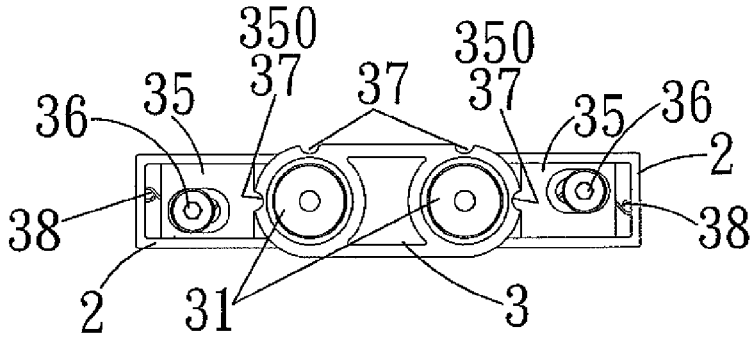
FIG. 12 is a bottom view of the combination cabinet as shown in FIG. 6.
Figure 13:
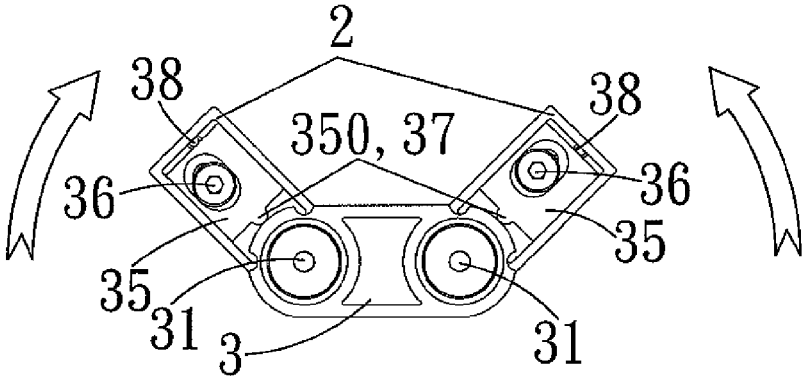
FIG. 13 is a schematic operational view of the combination cabinet as shown in FIG. 12.
Figure 14:
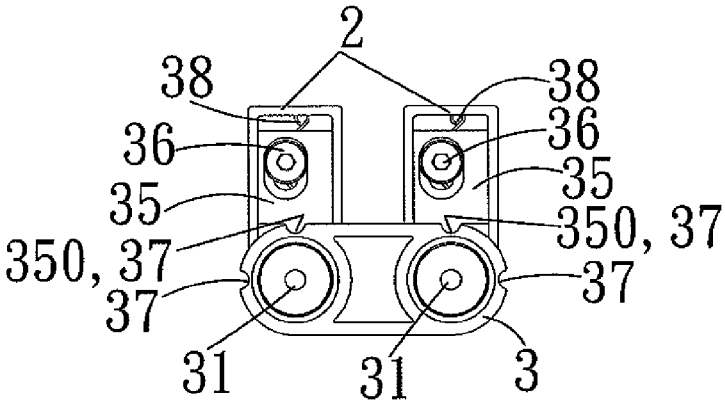
FIG. 14 is a schematic operational view of the combination cabinet as shown in FIG. 13.

The gears 310 meshes with each other so that the door frames 1 are pivoted simultaneously. Thus, the door frames 1 are moved exactly and smoothly. Each of the two opposite ends of each of the fixing seats 3 has a periphery provided with at least two positioning grooves 37. In the preferred embodiment of the present invention, each of the fixing seats 3 has two positioning grooves 37. Each of the positioning pieces 35 has a side provided with a positioning boss 350 positioned in one of the positioning grooves 37 of the respective fixing seat 3 so that the door frames 1 are positioned temporarily as shown in FIGS. 12 and 14.

Figure 15:
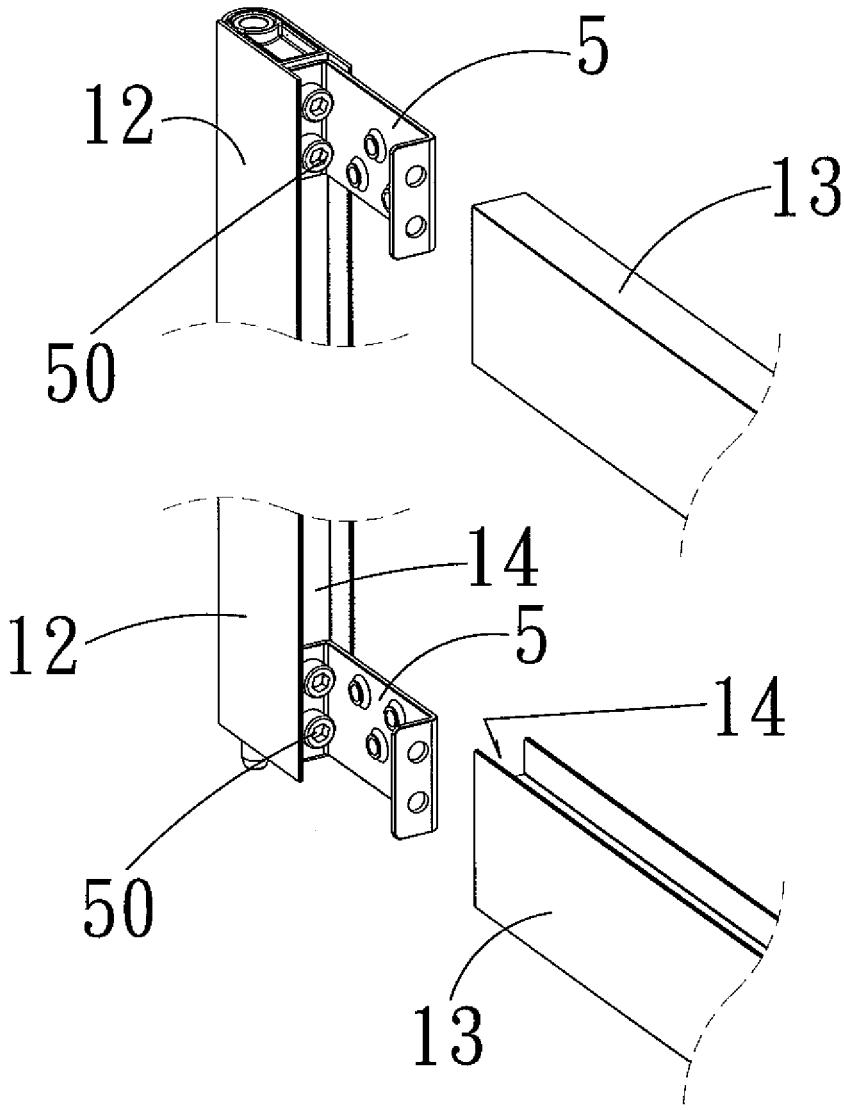
FIG. 15 is a partially exploded perspective view of a door frame of the combination cabinet in accordance with the preferred embodiment of the present invention.

Referring to FIG. 15, each of the door frames 1 includes two upright rails 12 (only one of the upright rails 12 is shown) and two cross rails 13 each mounted between the upright rails 12. The upright rails 12 and the cross rails 13 of each of the door frames 1 are connected by plurality of connecting plates 5. Each of the upright rails 12 and the cross rails 13 of each of the door frames 1 has a side provided with a fixing channel 14 for fixing the connecting plates 5 by a plurality of fixing members 50.

Figure 16:
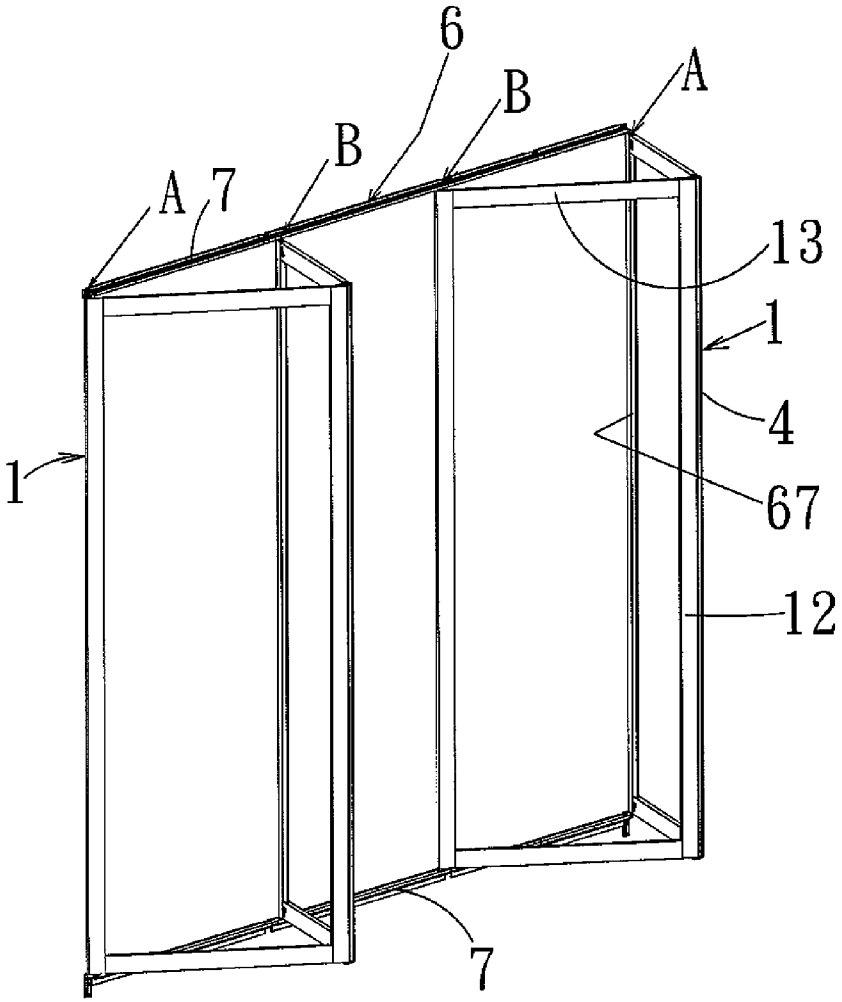
FIG. 16 is a perspective view of the combination cabinet in accordance with the preferred embodiment of the present invention.

Referring to FIG. 16, the combination cabinet comprises two pairs of pivotally connected door frames 1, and further comprises a cabinet unit 6 connected with the door frames 1. Each of the door frames 1 has a fixed side "A" pivotally connected with the cabinet unit 6 and a movable side "B" slidably connected with the cabinet unit 6.

Figure 17:
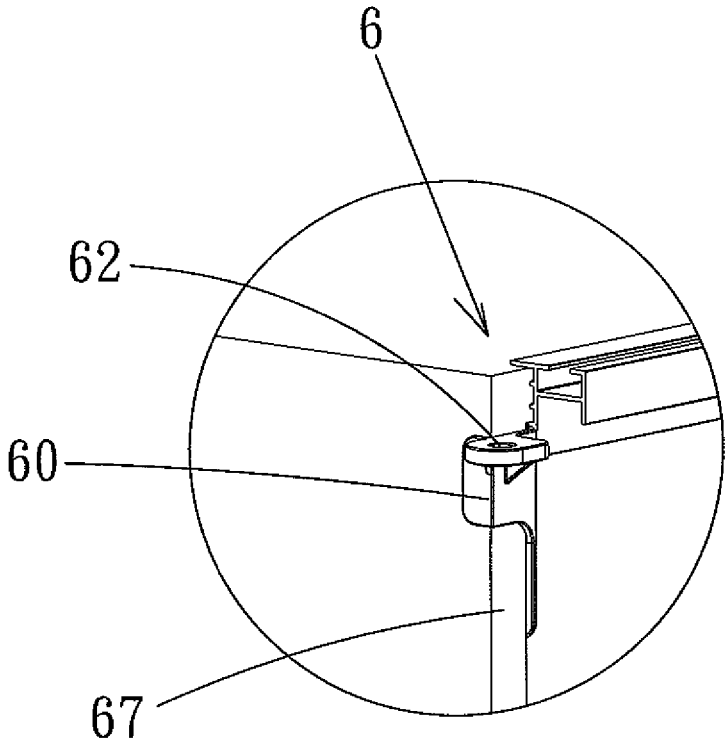
FIG. 17 is a partially perspective view of the upper end of a cabinet unit of the combination cabinet as shown in FIG. 16.
Figure 18:
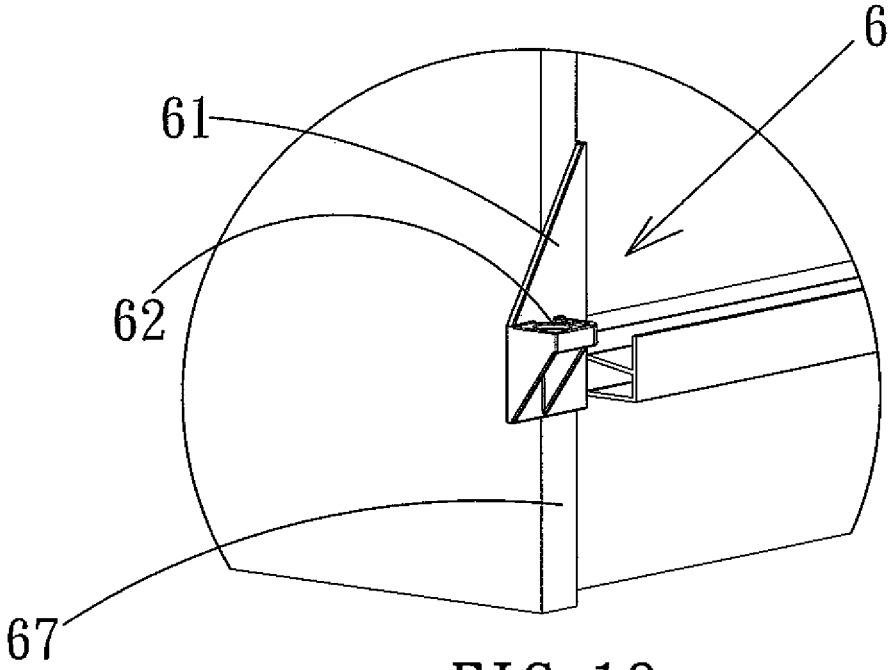
FIG. 18 is a partially perspective view of the lower end of the cabinet unit of the combination cabinet as shown in FIG. 16.
Figure 19:
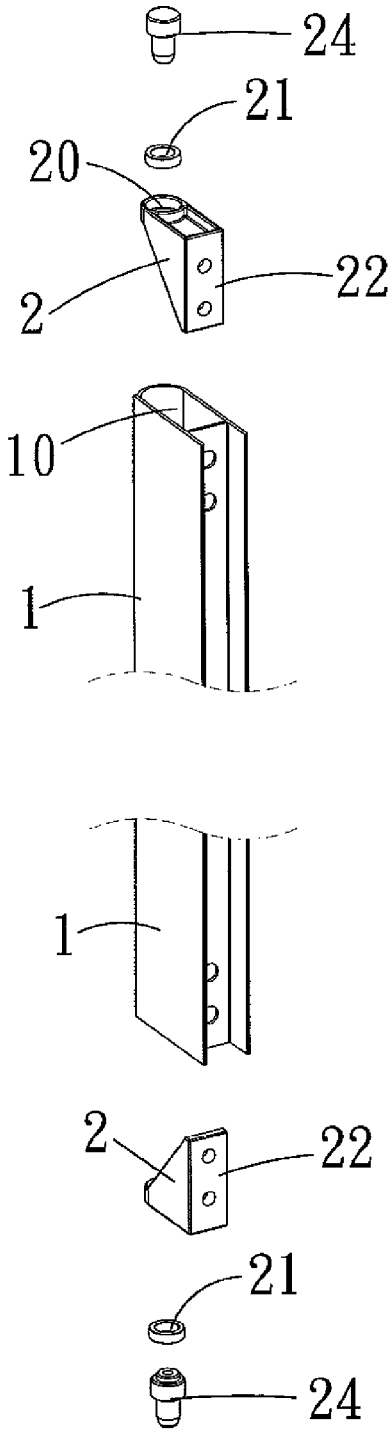
FIG. 19 is a partially exploded perspective view of the combination cabinet as shown in FIG. 16.
Figure 20:
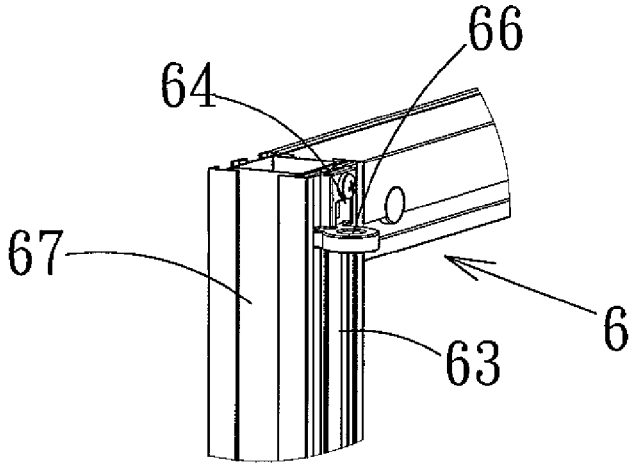
FIG. 20 is a partially perspective view of the upper end of a cabinet unit of a combination cabinet in accordance with another preferred embodiment of the present invention.
Figure 21:
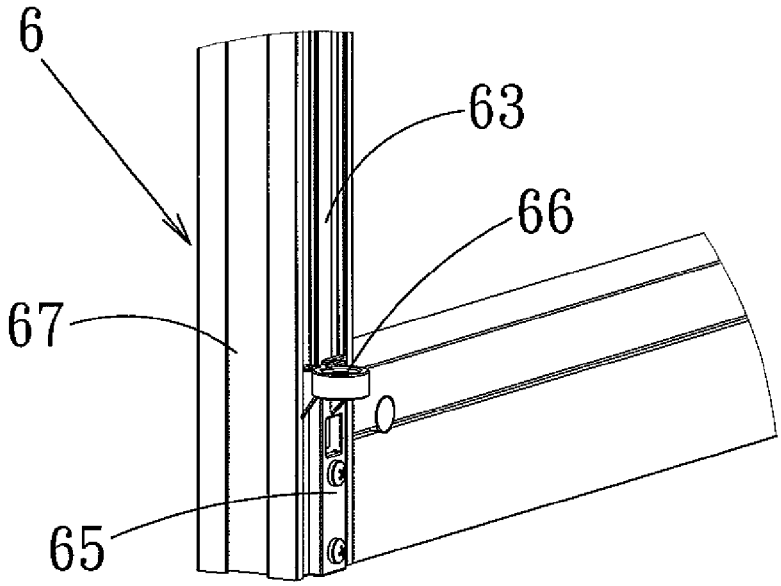
FIG. 21 is a partially perspective view of the lower end of the cabinet unit of the combination cabinet in accordance with another preferred embodiment of the present invention.
Figure 22:
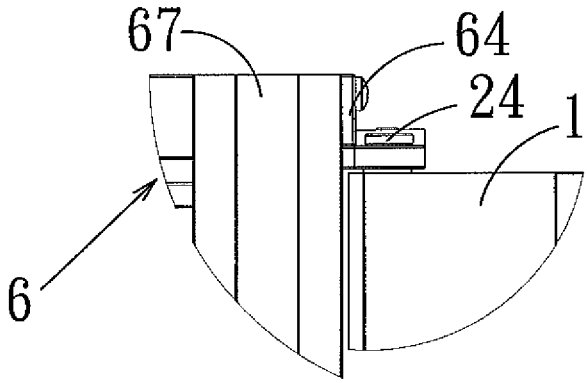
FIG. 22 is a side assembly view of the cabinet unit and the door frame as shown in FIG. 20.
Figure 23:
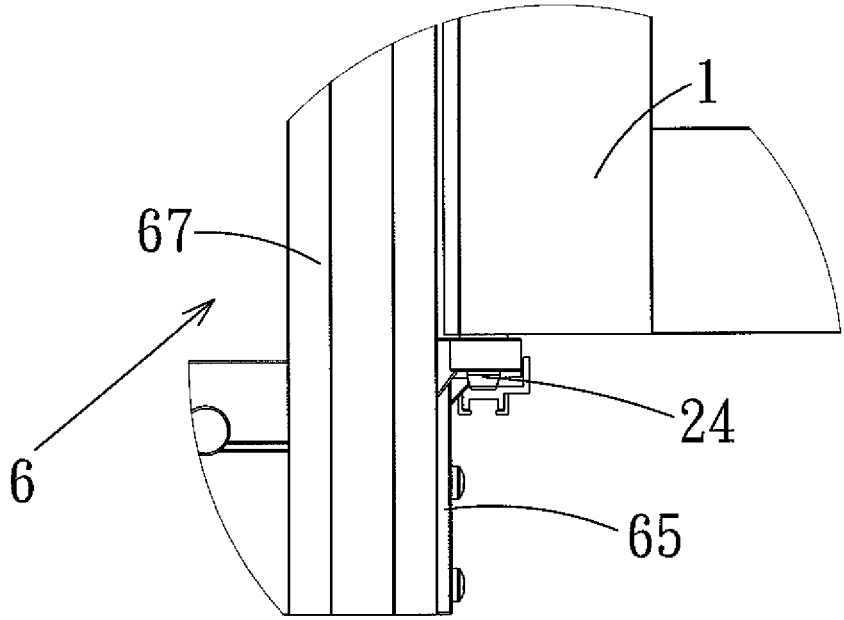
FIG. 23 is a side assembly view of the cabinet unit and the door frame as shown in FIG. 21.
Figure 24:
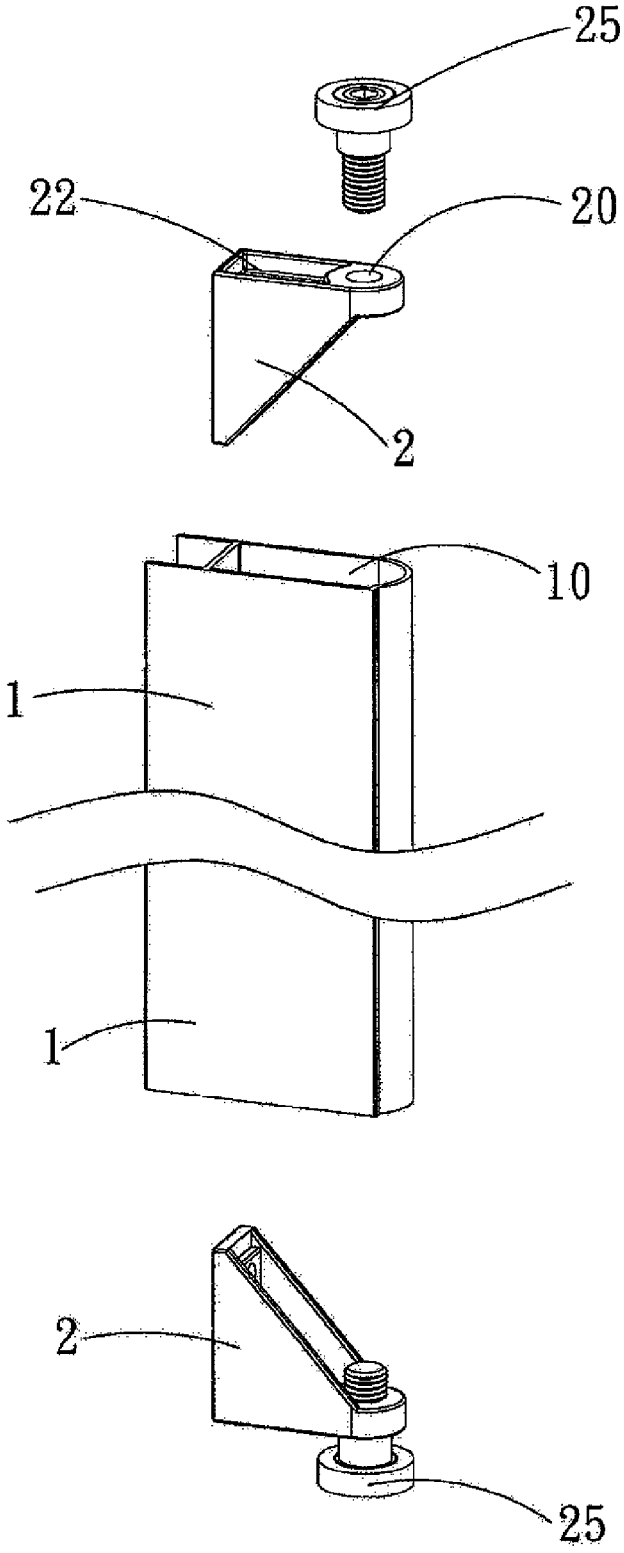
FIG. 24 is a partially exploded perspective view of the combination cabinet as shown in FIG. 16.
Figure 25:
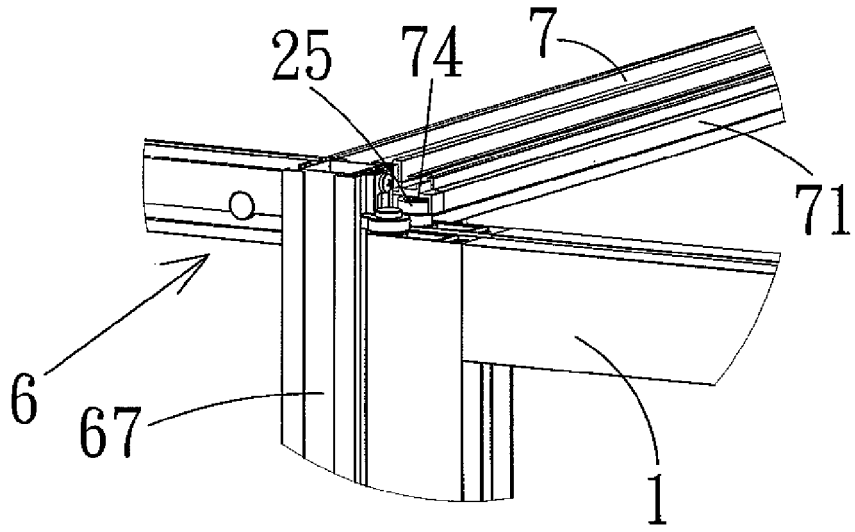
FIG. 25 is a partially perspective view of the upper end of the combination cabinet as shown in FIG. 16.
Figure 26:
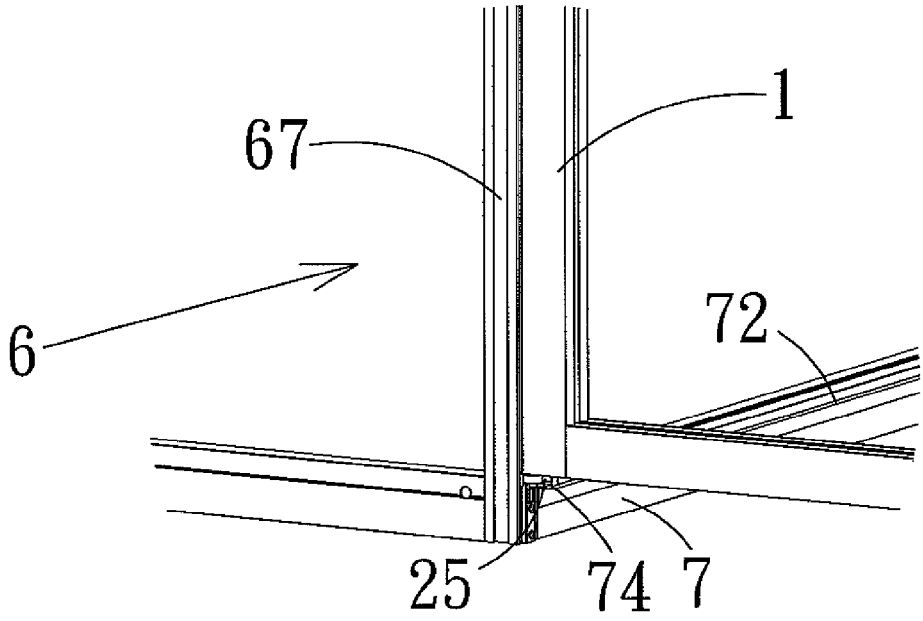
FIG. 26 is a partially perspective view of the lower end of the combination cabinet as shown in FIG. 16.
Figure 27:
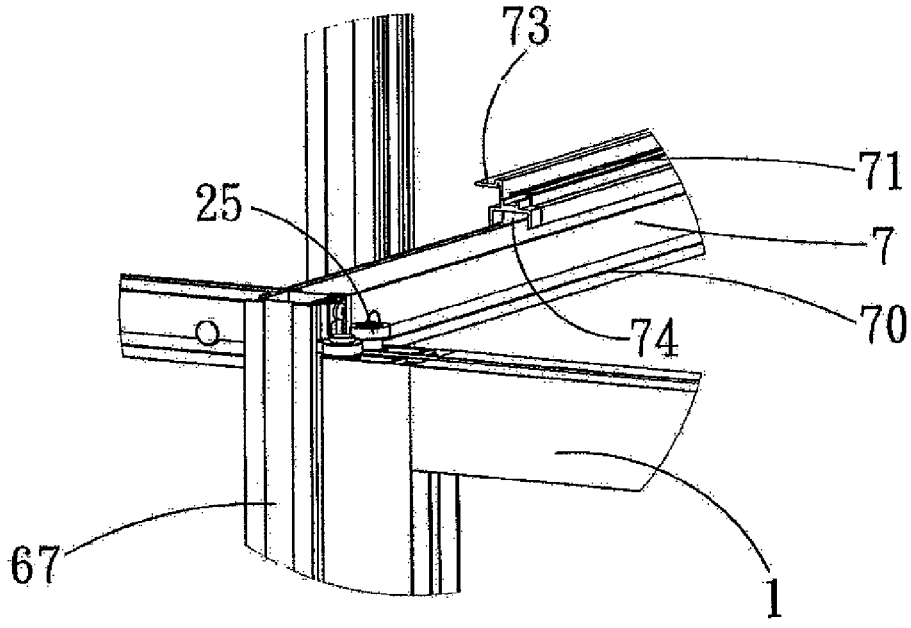
FIG. 27 is a partially exploded perspective view of the upper end of the combination cabinet as shown in FIG. 25.
Figure 28:
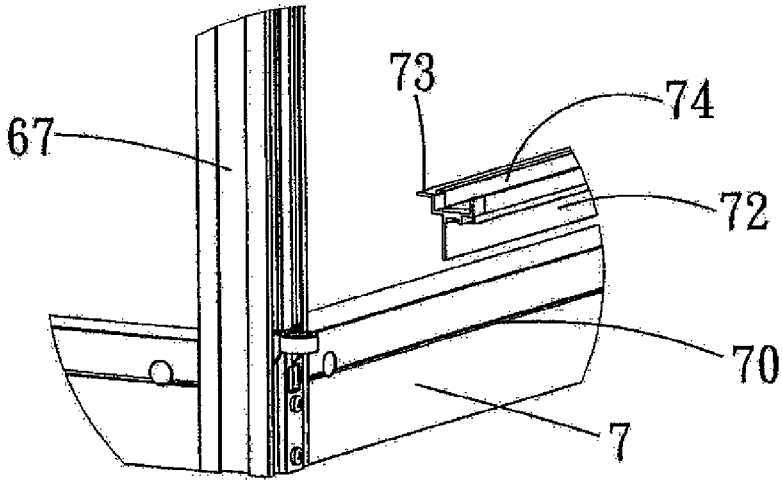
FIG. 28 is a partially exploded perspective view of the lower end of the combination cabinet as shown in FIG. 26.
Figure 29:
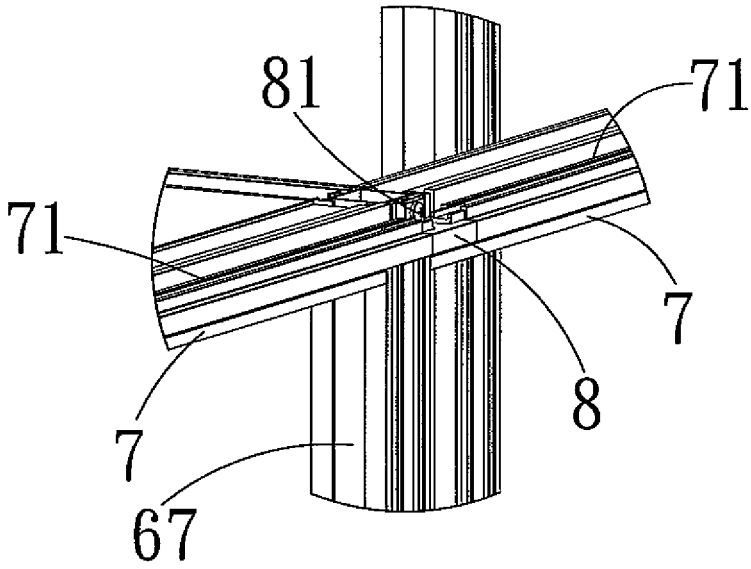
FIG. 29 is a partially perspective view of the upper end of a cabinet unit of a combination cabinet in accordance with another preferred embodiment of the present invention.
Figure 30:
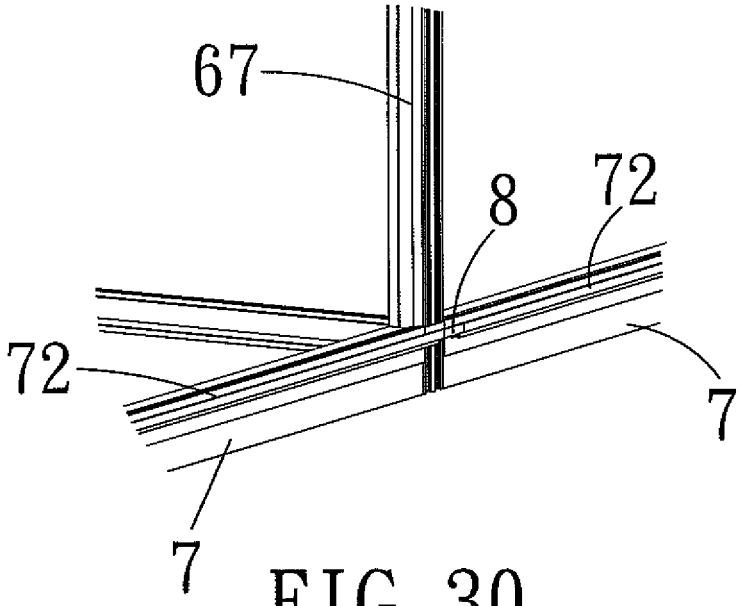
FIG. 30 is a partially perspective view of the lower end of the cabinet unit of the combination cabinet in accordance with another preferred embodiment of the present invention.
Figure 31:
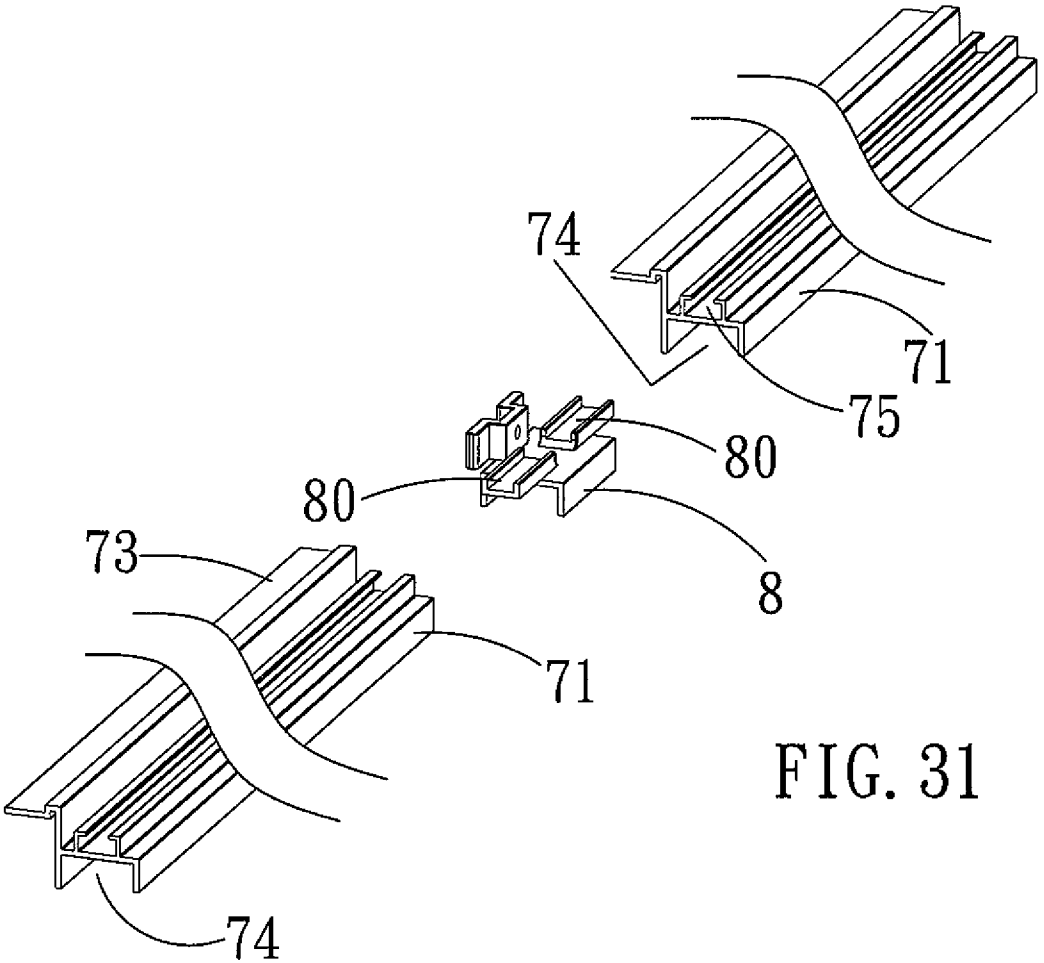
FIG. 31 is a partially exploded perspective view of the lower end of the cabinet unit of the combination cabinet as shown in FIG. 29.
Figure 32:
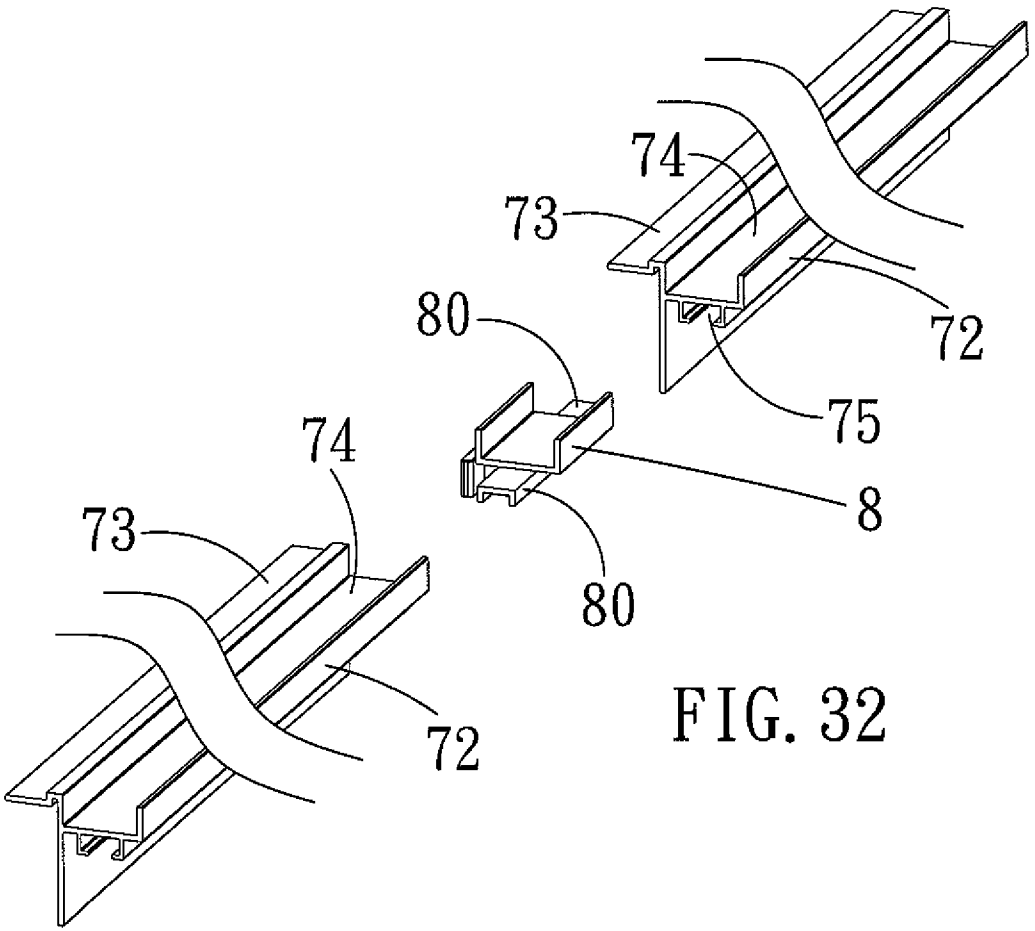
FIG. 32 is a partially exploded perspective view of the lower end of the cabinet unit of the combination cabinet as shown in FIG. 30.
Figure 33:
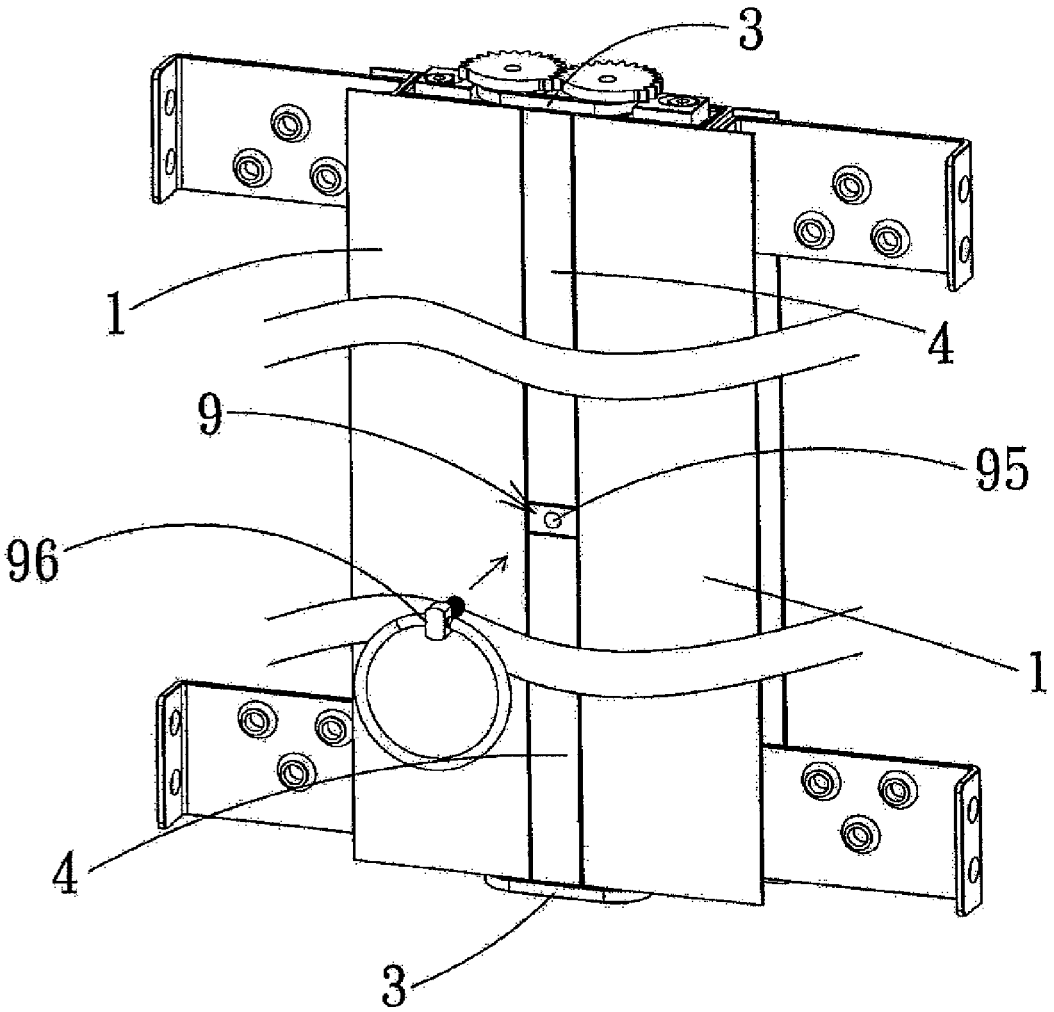
FIG. 33 is a partially perspective view of a combination cabinet in accordance with another preferred embodiment of the present invention.
Figure 35:
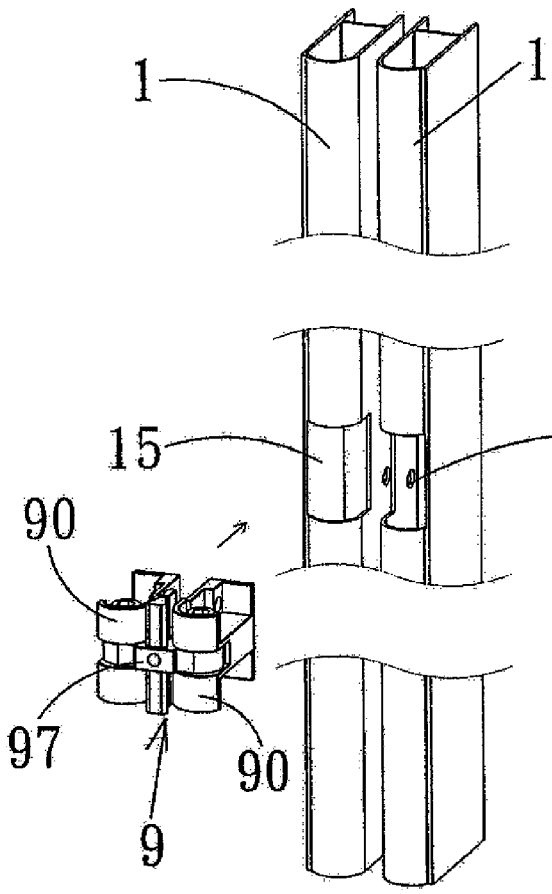
FIG. 35 is a partially exploded perspective view of the combination cabinet as shown in FIG. 34.
Figure 34:
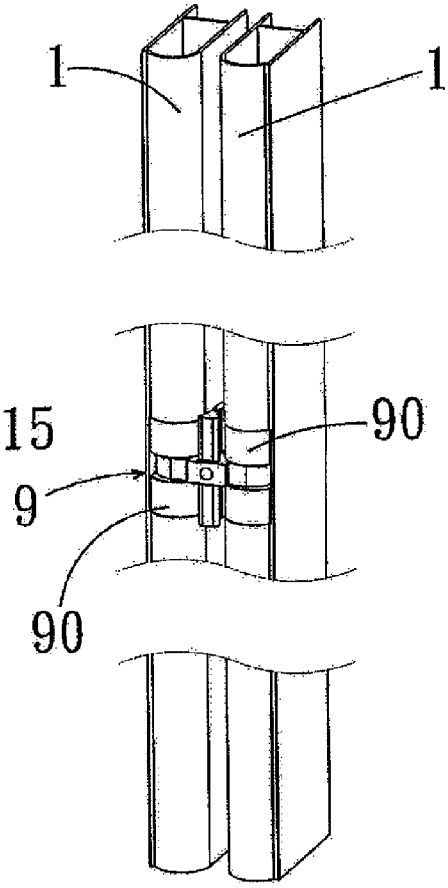
FIG. 34 is a partially operational view of the combination cabinet as shown in FIG. 33.
Figure 36:
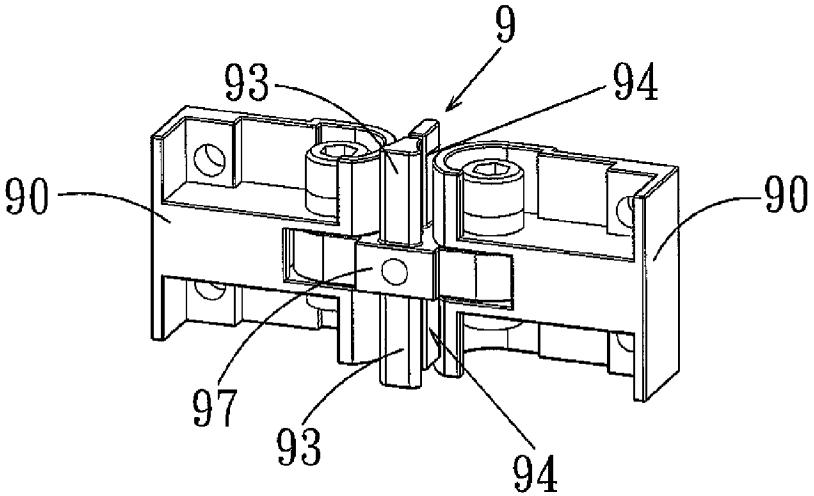
FIG. 36 is a perspective view of a reinforcing unit of the combination cabinet as shown in FIG. 35.
Figure 37:
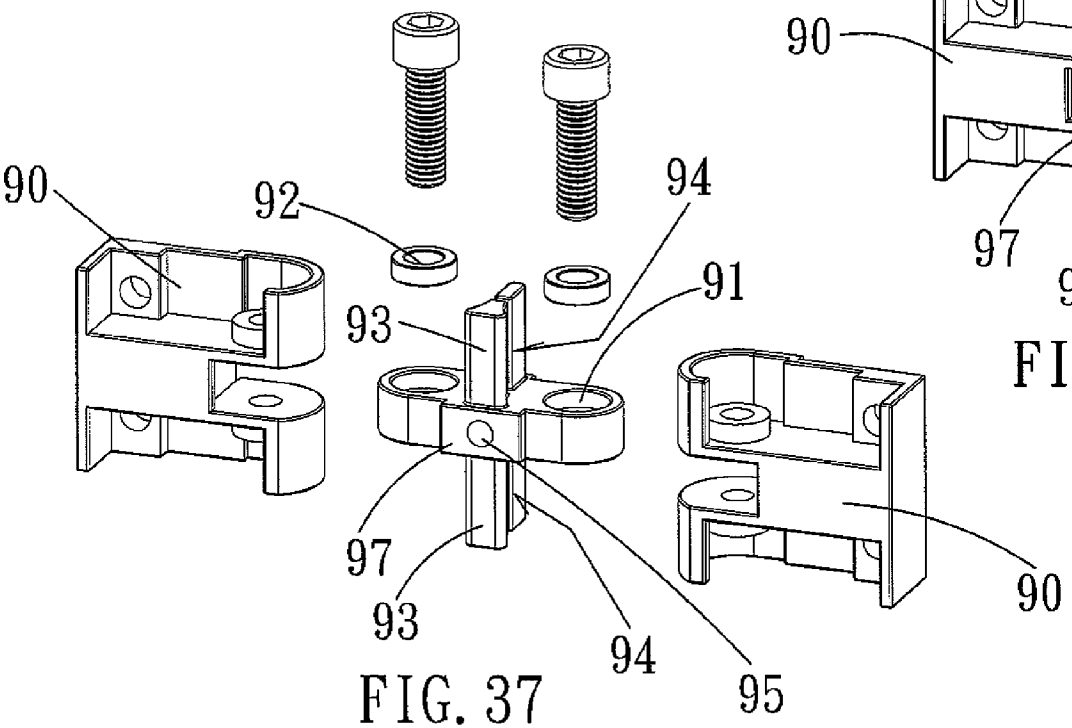
FIG. 37 is an exploded perspective view of the reinforcing unit of the combination cabinet as shown in FIG. 36.

Referring to FIGS. 17-19, the cabinet unit 6 includes at least one upright post 67, at least one upper support seat 60 mounted on an upper end of the upright post 67, and at least one lower support seat 61 mounted on a lower end of the upright post 67. Each of the upper support seat 60 and the lower support seat 61 of the cabinet unit 6 is provided with a through hole 62.

The fixed side "A" of each of the door frames 1 has an upper end and a lower end each provided with a fixing hole 10 for mounting a respective one of the pivot pieces 2. Each of the pivot pieces 2 at the fixed side "A" of each of the door frames 1 is pivotally connected with the cabinet unit 6 and has a first end provided with a shaft hole 20 for mounting a respective one of the bearings 21, and a second end provided with a fixing portion 22 secured in the fixing hole 10 of the respective door frame 1.

The combination cabinet further comprises a pair of axles 24 each extended through the through hole 62 of the upper support seat 60 or the lower support seat 61 of the cabinet unit 6 and the shaft hole 20 of a respective one of the pivot pieces 2 so that the fixed side "A" of each of the door frames 1 is pivotally connected between the upper support seat 60 and the lower support seat 61 of the cabinet unit 6.

Referring to FIGS. 19-23, the upright post 67 of the cabinet unit 6 has a side provided with a mounting channel 63 for mounting the upper support seat 64 and the lower support seat 65. Each of the upper support seat 64 and the lower support seat 65 of the cabinet unit 6 is provided with a through hole 66. Each of the axles 24 is extended through the through hole 66 of the upper support seat 64 or the lower support seat 65 of the cabinet unit 6 and the shaft hole 20 of a respective one of the pivot pieces 2 so that the fixed side "A" of each of the door frames 1 is pivotally connected between the upper support seat 64 and the lower support seat 65 of the cabinet unit 6.

Referring to FIGS. 24-28, the cabinet unit 6 further includes two is cross beams 7 mounted on the upper end and the lower end of the upright post 67 respectively, at least one upper track 71 mounted on a respective one of the cross beams 7, and at least one lower track 72 mounted on a respective one of the cross beams 7. Each of the upper track 71 and the lower track 72 of the cabinet unit 6 has a surface provided with a slideway 74 and has a side provided with a connecting portion 73. Each of the cross beams 7 of the cabinet unit 6 has a side provided with an opening 70 for mounting the connecting portion 73 of each of the upper track 71 and the lower track 72.

The movable side "B" of each of the door frames 1 has an upper end and a lower end each provided with a fixing hole 10 for mounting a respective one of the pivot pieces 2. Each of the pivot pieces 2 at the movable side "B" of each of the door frames 1 has a first end provided with a shaft hole 20, and a second end provided with a fixing portion 22 secured in the fixing hole 10 of the respective door frame 1.

The combination cabinet further comprises a pair of rollers 25 each rotatably mounted on the shaft hole 20 of a respective one of the pivot pieces 2 and each slidable in the slideway 74 of the upper track 71 or the lower track 72 of the cabinet unit 6 so that the movable side "B" of each of the door frames 1 is slidably connected with the cabinet unit 6.

Referring to FIGS. 29-32, the cabinet unit 6 includes a plurality of upper tracks 71 and a plurality of lower tracks 72, and further includes a plurality of connectors 8 mounted between the upper tracks 71 to connect the upper tracks 71, and mounted between the lower tracks 72 to connect the lower tracks 72. Each of the upper tracks 71 and the lower tracks 72 of the cabinet unit 6 is provided with a first connecting bracket 75. Each of the connectors 8 is provided with two second connecting brackets 80 each connected with the first connecting bracket 75 of each of the upper tracks 71 and the lower tracks 72. Thus, the upper tracks 71 are connected by the connectors 8, and the lower tracks 72 are connected by the connectors 8. Each of the connectors 8 is affixed to each of the cross beams 7 by a locating member 81.

Referring to FIGS. 33-37, the combination cabinet comprises at least two juxtaposed separation bars 4 each mounted between the door frames 1, and a reinforcing unit 9 mounted between the separation bars 4 to reinforce the strength of the separation bars 4. The reinforcing unit 9 includes a support base 97 located between the separation bars 4, two clamping brackets 90 each pivotally connected with the support base 97 and each secured on a respective one of the door frames 1, two rotation members 92 each mounted between the support base 97 and a respective one of the clamping brackets 90, and a handle 96 secured on the support base 97 to move the door frames 1. The support base 97 of the reinforcing unit 9 is disposed between the clamping brackets 90 and has two opposite ends each provided with a receiving hole 91 for mounting a respective one of the rotation members 92. The support base 97 of the reinforcing unit 9 has a middle position provided with two plugs 93 each inserted into a respective one of the separation bars 4 to locate the support base 97 between the separation bars 4. The support base 97 of the reinforcing unit 9 has a surface provided with a retaining hole 95 for mounting the handle 96. Each of the plugs 93 of the support base 97 has a side provided with a fixing edge 94 secured in the respective separation bar 4. Each of the rotation members 92 of the reinforcing unit 9 is preferably a bearing. Each of the door frames 1 has a surface provided with a locking groove 15 for locking a respective one of the clamping brackets 90 of the reinforcing unit 9.

Accordingly, the separation bar 4 fully seals the gap between the door frames 1 when the door frames 1 are fully expanded, fully folded or inclined relative to each other, thereby enhancing the aesthetic quality of the door frames 1. In addition, the separation bar 4 closes the gap between the door frames 1 during pivotal movement of the door frames 1, thereby preventing a person from being clamped or hurt by the gap between the door frames 1. Further, the gears 310 meshes with each other to pivot the door frames 1 simultaneously so that the door frames 1 are moved smoothly and conveniently. Further, the reinforcing unit 9 provides a reinforcing function to prevent the door frames 1 from being vibrated or shocked during movement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination cabinet comprising:

at least one pair of door frames;

at least one separation bar mounted between the at least one pair of door frames;

a pair of fixing seats mounted on the at least one separation bar;

a plurality of pivot pieces each mounted in a respective one of the at least one pair of door frames and each pivotally connected with a respective one of the pair of fixing seats, wherein:

the at least one separation bar has an upper end and a lower end each provided with a slot for mounting a respective one of the pair of pair of fixing seats;

each of the pair of fixing seats has a side provided with an insert inserted into a respective slot of the at least one separation bar;

each of the at least one pair of door frames has an upper end and a lower end each provided with a fixing hole for mounting a respective one of the plurality of pivot pieces;

each of the plurality of pivot pieces has a first end provided with a shaft hole, and a second end provided with a fixing portion secured in the fixing hole of a respective door frame;

each of the pair of fixing seats has two opposite ends each provided with a shaft bore; and the shaft bore of each of the pair of fixing seats aligns with the shaft hole of a respective one of the plurality of pivot pieces;

two pairs of shafts each extended through the shaft bore of a respective one of the pair of fixing seats and the shaft hole of a respective one of the plurality of pivot pieces to pivotally connect the pair of fixing seats with the plurality of pivot pieces; and a plurality of bearings each mounted in the shaft hole of a respective one of the plurality of pivot pieces.

2. The combination cabinet of claim 1, wherein:

the combination cabinet further comprises:

one pair of gears each secured on a respective one of the two pairs of shafts and each aligning with an upper one of the pair of fixing seats;

two pairs of positioning pieces each secured on a respective one of the plurality of pivot pieces; and two pairs of springs each mounted on a respective one of the two pairs of positioning pieces and each biased between a respective one of the plurality of pivot pieces and a respective one of the pair of fixing seats to provide a restoring function to the at least one pair of door frames;

the one pair of gears meshes with each other;

each of the two opposite ends of each of the pair of fixing seats has a periphery provided with at least two positioning grooves; and each of the two pairs of positioning pieces has a side provided with a positioning boss positioned in one of the at least two positioning grooves of a respective fixing seat.

3. The combination cabinet of claim 1, wherein:

each of the at least one pair of door frames has a side provided with a first arcuate portion;

each of the plurality of pivot pieces has a side provided with a second arcuate portion abutting the first arcuate portion of the respective door frame;

the at least one separation bar has two opposite sides each provided with a third arcuate portion abutting the first arcuate portion of the respective door frame; and the insert of each of the pair of fixing seats has two opposite sides each provided with a fourth arcuate portion abutting a respective third arcuate portion of the at least one separation bar.

4. The combination cabinet of claim 1, wherein:

each of the at least one pair of door frames includes two upright rails and two cross rails each mounted between the two upright rails;

the two upright rails and the two cross rails of each of the at least one pair of door frames are connected by plurality of connecting plates; and each of the two upright rails and the two cross rails of each of the at least one pair of door frames has a side provided with a fixing channel for fixing the plurality of connecting plates by a plurality of fixing members.

5. The combination cabinet of claim 1, wherein:

the combination cabinet further comprises a cabinet unit connected with the at least one pair of door frames;

each of the at least one pair of door frames has a fixed side pivotally connected with the cabinet unit and a movable side slidably connected with the cabinet unit;

the cabinet unit includes:

at least one upright post;

at least one upper support seat mounted on an upper end of the at least one upright post; and at least one lower support seat mounted on a lower end of the at least one upright post;

each of the at least one upper support seat and the at least one lower support seat of the cabinet unit is provided with a through hole;

the fixed side of each of the at least one pair of door frames has an upper end and a lower end each provided with a fixing hole for mounting a respective one of the plurality of pivot pieces;

each of the plurality of pivot pieces at the fixed side of each of the at least one pair of door frames is pivotally connected with the cabinet unit and has a first end provided with a shaft hole, and a second end provided with a fixing portion secured in the fixing hole of the respective door frame; and the combination cabinet further comprises a pair of axles each extended through the through hole of the at least one upper support seat or the at least one lower support seat of the cabinet unit and the shaft hole of a respective one of the plurality of pivot pieces with the fixed side of each of the at least one pair of door frames pivotally connected between the at least one upper support seat and the at least one lower support seat of the cabinet unit.

6. The combination cabinet of claim 5, wherein the at least one upright post of the cabinet unit has a side provided with a mounting channel for mounting the at least one upper support seat and the at least one lower support seat.

7. A combination cabinet comprising:

at least one pair of door frames;

at least one separation bar mounted between the at least one pair of door frames;

a pair of fixing seats mounted on the at least one separation bar;

a plurality of pivot pieces each mounted in a respective one of the at least one pair of door frames and each pivotally connected with a respective one of the pair of fixing seats;

a cabinet unit connected with the at least one pair of door frames; wherein: the at least one separation bar has an upper end and a lower end each provided with a slot for mounting a respective one of the pair of pair of fixing seats; each of the pair of fixing seats has a side provided with an insert inserted into a respective slot of the at least one separation bar;

each of the at least one pair of door frames has a fixed side pivotally connected with the cabinet unit and a movable side slidably connected with the cabinet unit;

the cabinet unit further includes:

at least one upright post;

two cross beams mounted on an upper end and a lower end of the at least one upright post respectively;

at least one upper track mounted on a respective one of the two cross beams; and at least one lower track mounted on a respective one of the two cross beams;

each of the at least one upper track and the at least one lower track of the cabinet unit has a surface provided with a slideway;

the movable side of each of the at least one pair of door frames has an upper end and a lower end each provided with a fixing hole for mounting a respective one of the plurality of pivot pieces; and each of the plurality of pivot pieces at the movable side of each of the at least one pair of door frames has a first end provided with a shaft hole, and a second end provided with a fixing portion secured in the fixing hole of a respective door frame; and a pair of rollers each rotatably mounted on the shaft hole of a respective one of the plurality of pivot pieces and each slidable in the slideway of the at least one upper track or the at least one lower track of the cabinet unit with the movable side of each of the at least one pair of door frames is slidably connected with the cabinet unit.

8. The combination cabinet of claim 7, further comprising a plurality of bearings each mounted in the shaft hole of a respective one of the plurality of pivot pieces.

9. The combination cabinet of claim 7, wherein:

each of the at least one upper track and the at least one lower track of the cabinet unit has a side provided with a connecting portion; and each of the two cross beams of the cabinet unit has a side provided with an opening for mounting the connecting portion of each of the at least one upper track and the at least one lower track.

10. The combination cabinet of claim 9, wherein:

the at least one upper track includes a plurality of upper tracks and the at least one lower track includes a plurality of lower tracks;

the cabinet unit further includes a plurality of connectors mounted between the plurality of upper tracks to connect the plurality of upper tracks, and mounted between the plurality of lower tracks to connect the plurality of lower tracks;

each of the plurality of upper tracks and the plurality of lower tracks of the cabinet unit is provided with a first connecting bracket; and each of the plurality of connectors is provided with two second connecting brackets each connected with the first connecting bracket of each of the plurality of upper tracks and the plurality of lower tracks.

11. The combination cabinet of claim 10, wherein each of the plurality of connectors is affixed to each of the two cross beams by a locating member.

12. A combination cabinet comprising:

at least one pair of door frames;

at least two juxtaposed separation bars each mounted between the at least one pair of door frames;

a pair of fixing seats mounted on the at least two juxtaposed separation bars;

a plurality of pivot pieces each mounted in a respective one of the at least one pair of door frames and each pivotally connected with a respective one of the pair of fixing seats and a reinforcing unit mounted between the at least two juxtaposed separation bars to reinforce the strength of the at least two juxtaposed separation bars; wherein:

the reinforcing unit includes:

a support base located between the at least two juxtaposed separation bars;

two clamping brackets each pivotally connected with the support base and each secured on a respective one of the at least one pair of door frames; and two rotation members each mounted between the support base and a respective one of the two clamping brackets;

the support base of the reinforcing unit is disposed between the two clamping brackets and has two opposite ends each provided with a receiving hole for mounting a respective one of the two rotation members;

the support base of the reinforcing unit has a middle position provided with two plugs each inserted into a respective one of the at least two juxtaposed separation bars to locate the support base between the at least two juxtaposed separation bars;

each of the two plugs of the support base has a side provided with a fixing edge secured in the respective one of the at least two juxtoposed separation bars; and each of the at least one pair of door frames has a surface provided with a locking groove for locking a respective one of the two clamping brackets of the reinforcing unit.

13. The combination cabinet of claim 12, wherein:

the reinforcing unit further includes a handle secured on the support base to move the at least one pair of door frames; and the support base of the reinforcing unit has a surface provided with a retaining hole for mounting the handle.

* * * * *